United States Patent [19]

Carr

[11] 4,438,924

[45] Mar. 27, 1984

[54] GAME BALL

[76] Inventor: Ian Carr, 740 S. Federal, Apt. 1104, Chicago, Ill. 60605

[21] Appl. No.: 253,110

[22] Filed: Apr. 13, 1981

[51] Int. Cl.[3] ..... A63B 39/00

[52] U.S. Cl. ..... 273/58 B; 273/58 K

[58] Field of Search ..... 273/58 K, 60 R, 60 A, 273/60 B, 58 B, 232, 63 D, 220, 221, 222, 223, 224, 225, 226, 227, 228, 229, 230, 26 R, 61 R, 167 J, 425, 61 A

[56] References Cited

U.S. PATENT DOCUMENTS

| | | | |
|---|---|---|---|
| 697,417 | 4/1902 | Kempshall | 273/218 |
| 1,265,036 | 5/1918 | Bendelow | 273/232 |
| 1,684,557 | 9/1928 | Saunders | 273/61 A |
| 2,135,210 | 11/1938 | Farrar | 273/232 |
| 2,683,603 | 7/1954 | Gackenbach | 273/425 X |
| 2,776,139 | 1/1957 | Blamey et al. | 273/60 B |
| 3,115,129 | 12/1963 | Merriman | 273/58 K X |
| 3,819,190 | 6/1974 | Nepela et al. | 273/232 |
| 3,908,993 | 9/1975 | Gentiluomo | 273/60 R |
| 3,908,994 | 9/1975 | Astrom | 273/61 R |
| 3,917,271 | 11/1975 | Lemelson et al. | 273/61 A X |
| 3,927,881 | 12/1975 | Lemelson et al. | 273/58 K |
| 4,045,026 | 8/1977 | Gillespie et al. | 273/58 B X |
| 4,142,727 | 3/1979 | Shaw et al. | 273/232 |
| 4,184,682 | 1/1980 | Collins et al. | 273/58 K X |
| 4,256,304 | 3/1981 | Smith et al. | 273/60 B |
| 4,266,773 | 5/1981 | Treadwell | 273/232 |

FOREIGN PATENT DOCUMENTS

| | | | |
|---|---|---|---|
| 16862 | 10/1890 | United Kingdom | 273/232 |
| 60 | of 1902 | United Kingdom | 273/61 A |
| 221117 | 9/1924 | United Kingdom | 273/61 R |
| 616779 | 1/1949 | United Kingdom | 273/58 J |
| 904785 | 8/1962 | United Kingdom | 273/232 |

OTHER PUBLICATIONS

"Capital City Federal Home Owner", Jul.–Aug. 1972, Published by Capital City Federal Savings & Loan Association of Washington, D.C. p. 15.

*Primary Examiner*—George J. Marlo
*Attorney, Agent, or Firm*—Lee, Smith & Jager

[57] ABSTRACT

A spheroidal projectile with an aerodynamically roughened surface in the nature of intersecting grooves which give a high density of roughness elements. The grooves range in size between grooves of about 0.01 inch wide and deep, spaced about 1/32 of an inch apart for a "fine" degree of roughness to grooves which are 1/16 of an inch wide and deep, and spaced 1/16 of an inch. The projectile has a mass sufficiently low so that when launched at transltional and rotational speeds obtainable by hand, Magnus forces are enhanced by the roughness, and anti-Magnus forces are made to appear by this appropriate degree of roughness, the result of which is a trajectory with pronounced multiple curves. In accordance with the preferred embodiment, a surface speed of rotation of 8 feet per second is desirable and a ball of 15 grams having a 3 inch diameter would have a spin of about 10 revolutions per second. An acceptable ballistic (or linear) launch speed for the ball is about 55 feet per second.

32 Claims, 19 Drawing Figures

SMOOTH BALL ROTATING AT 8 FPS (10 RPS)

DISTANCE Vs DRAG IN FLIGHT—PATH

DISTANCE Vs MAX DRAG ON FAST SIDE OF BALL

DISTANCE Vs MAX. DRAG ON SLOW SIDE OF BALL

DISTANCE Vs
DIFFERENCE IN MAX. DRAG BETWEEN FAST & SLOW SIDES OF BALL

FLIGHT TRAJECTORY FROM OVERHEAD

ROUGH BALL ROTATING AT 8 FPS (10 RPS)

DISTANCE Vs DRAG IN FLIGHT-PATH

DISTANCE Vs MAX DRAG ON FAST SIDE OF BALL

DISTANCE Vs MAX DRAG ON SLOW SIDE OF BALL

DISTANCE Vs
DIFFERENCE IN MAX DRAG BETWEEN FAST & SLOW SIDES OF BALL

FLIGHT TRAJECTORY FROM OVERHEAD

FLIGHT TRAJECTORIES WITH DIFFERENT ROTATIONAL SPEEDS AS SEEN FROM OVERHEAD. – ROUGHENED BALL.

GAME BALL

FIELD OF THE INVENTION

This invention generally relates to spherical and spheroidal projectiles having improved aerodynamic properties. More specifically, this invention relates to spherical and spheroidal projectiles, such as game balls and the like, having selected surface roughening characteristics which allow Magnus and anti-Magnus effects associated with rotation to occur at lower and more readily achieved rotational and ballistic speeds when the projectile is in flight.

BACKGROUND AND GENERAL DESCRIPTION

Much effort has been directed in the past to making the trajectory of projectiles deviate predictably from their expected flight path, and to magnify such deviation. The ability to do this is highly prized, for example, by baseball pitchers, who strive to improve their curve balls. The manufacturers of toys and games have also sought to develop new and different game balls, and launch-assist equipment, so that when the ball is launched either from the hand or from launch-assist equipment, unusually curved flight paths occur.

As general background for this invention, it is accepted that a spherical projectile, such as a ball, will traverse a generally parabolic path, as viewed in the vertical plane, when launched into ballistic flight in still air. When similarly launched in still air rotating about a vertical or near vertical axis, the trajectory of the ball will also curve in a horizontal plane.

This horizontal curvature resulting when a ball rotates (spins) in ballistic flight results from a special case of the Bernoulli Principle known as the Magnus effect. As the ball spins in flight, points on one horizontal side travel in the same direction as the center of mass, and points on the opposite side travel in the opposite direction. The front and rear horizontal surfaces of the ball are also travelling in directions opposite to each other. The rotation of the ball in the air creates a net force perpendicular to the flight path so that the direction of horizontal curvature in flight is in the same direction as the travel of the front of the spinning ball. This horizontal deviation of the flight path of the spinning ball is hereinafter referred to as the Magnus curve of the ball.

Other aspects of the background leading to the present invention relate to Boundary Layer, Laminar Sublayer, Aerodynamic Roughness, Separation, Wake, Drag, Lift, Reynolds number and Critical Reynolds number. When an aerodynamically smooth body travels through a viscous fluid, there is a zone between the body and the free stream of the fluid called the boundary layer. Flow in the boundary layer near the leading part of the body is laminar but as the layer extends along the surface of the body backwards from the leading portion, a transition line is reached, if the surface is long enough, at which the flow in the boundary layer becomes turbulent. Whether or not flow in the boundary layer is turbulent there still exists deep to the boundary layer and adjacent to the surface of the body a narrow region of fluid in which the flow remains laminar; this is known as the laminar sublayer. Aerodynamic smoothness implies that no parts of the surface of the body protrude through the laminar sublayer. When parts of the surface of the body do protrude through the laminar sublayer, the surface is said to be aerodynamically rough. Roughness may be present to a greater or lesser degree and is quantifiable.

As the boundary layer extends backwards from the leading portion of the body it becomes progressively thicker and the velocity profile within the boundary layer changes, the velocity in the layers closer to the surface of the body decreasing progressively. At the level where the velocity in the deeper layer first falls to zero the boundary layer separates from the body and the zone to the rear of this level is called the wake. The wake retards forward motion. All forces retarding forward motion are called drag and the larger the area of surface from which the wake arises the greater is this form of drag. The boundary layer itself is associated with a form of drag called viscous drag.

When forward flight energy is translated into deviations from expected trajectory, these deviations may be regarded as lift (independently of the actual direction of such deviation) and such translation is associated with another form of drag called induced drag.

If the outer laminar boundary layer is made turbulent, then the boundary layer will not separate until further back from the leading part of the body, with the result that the wake is narrower and this source of drage is diminished. Although the viscous drag of the turbulent boundary layer is higher than that of the laminar boundary layer, the total drag is less because the wake is so much narrower. Aerodynamic roughness can cause such turbulence and thereby result in diminution in total drag. This phenomenon has been utilized in the design of golf balls which are manufactured with patterns of depressions (or elevations, according to one's perspective) on the surface. When struck by a golf club in the usual way, the surface pattern is believed to increase the Magnus effect of the spinning ball, increasing lift, narrowing the wake and more than counterbalancing any increase in viscous drag so that the now aerodynamically roughened golf ball will travel further than an aerodynamically smooth golf ball.

The transition from laminar to turbulent flow is promoted: (1) by increasing the relative velocity, u, of surface and free fluid stream; (2) by decreasing kinematic viscosity, v of the fluid, here air, and (3) at increasing distance, x, from the leading portion of the body. These three variables are combined to form a characteristic number called the Reynolds number, so that, $$R = u.x/v$$

For the purposes of this invention, relative velocity, u, is the control variable.

The relation between drag and R for a given sphere is shown in FIG. 1 of the drawings. Generally, as the velocity increases, R increases and drag increases; conversely as velocity decreases, R decreases and drag decreases. The transition from laminar to turbulent flow occurs over a critical range of Reynolds number. Above that critical range flow will be turbulent and below that range it will be laminar. As points on the surface of the body pass through the critical range of Reynolds number, flow will tend to change from laminar to turbulent or from turbulent to laminar, according to whether the points are accelerating or decelerating. At the critical range of Reynolds number, the general trend is interrupted and, over a short span of R values, as velocity increases, and therefore R values increase, drag decreases. Conversely, as velocity decreases, and therefore R values decrease, drag increases. In ballistic spinning flight the speed of both the center of mass and of spin are decreasing so that drag is generally decreasing except during passage through the critical range of R values, when drag transiently increases. With a smooth ball the critical range of R values is much higher than with a rough ball and to pass through the critical range requires a combination of ballistic speed and spin not readily attainable by the human hand, although readily attainable with launch assisting equipment. Furthermore, since the lateral forces involved are so small, the greater momentum and higher speeds will minimize the amount of deviation. Appropriate roughening of the surface of the ball will lower the critical range of R values so that to pass through the critical range requires a lower range of ballistic speeds and spin, readily obtainable by the human hand. The lower momentum and lower speeds will permit greater deviations from expected flight trajectory.

If the free air-stream velocity and speed of rotation are high enough, then the critical range of Reynolds number could be exceeded at surface points on both sides of the sphere. As the free air-stream velocity and speed of rotation decrease in ballistic flight, points first on one side and then on the other side would fall through the critical range of Reynolds number and total drag would increase first on one side and then on the other. This would create asymmetric lateral forces whose algebraic sum opposed the Magnus curve and if of sufficient magnitude would cause the ball to curve in the opposite (anti-Magnus) direction until both sides had passed through the critical range of Reynolds number, when the Magnus curve would resume. Thus the ball would be directed along a flight path having a triple curve representing successively a Magnus curve, an anti-Magnus curve and finally a Magnus curve again.

According to the conditions at the beginning of ballistic flight (launch) and at the end of ballistic flight (where the ball strikes a bat, ground or hand, for example) the flight path could also shown one of two double curves (Magnus followed by anti-Magnus or anti-Magnus followed by Magnus) or one of two single curves, Magnus or anti-Magnus. If the design of the roughness and the axis of spin were appropriately adjusted unusual deviations in planes other than the horizontal, e.g., the vertical plane, could be achieved. The anti-Magnus curve singly and in various combinations with the Magnus curve are novel features of the present invention.

ILLUSTRATIVE EMBODIMENTS

Further objects and features of the present invention will become more apparent from the following description of computer-simulated performance data and of several illustrative embodiments, as shown in the accompanying drawings, in which.

Figure 18:
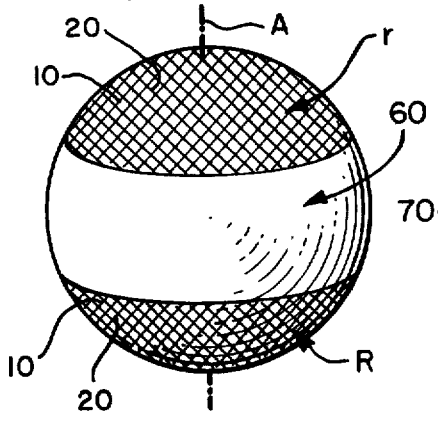
Figure 19:
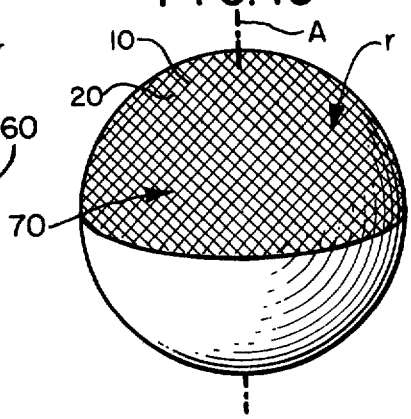
Figure 20:
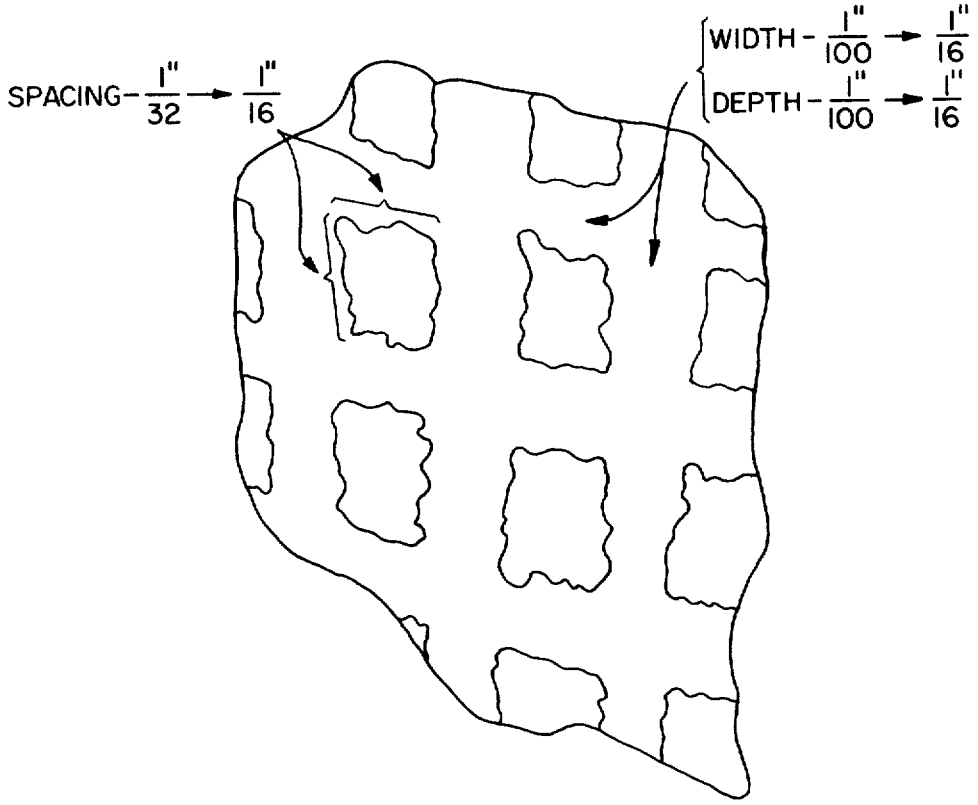

FIG. 18 illustrates a fourth embodiment of the invention where a wide band extending above and below the equator of the ball, between about 20° and 50° of latitude of both hemispheres, is aerodynamically smooth and the remainder is provided with aerodynamic roughness; and FIG. 19 illustrates a fifth embodiment of the invention where one hemisphere of the ball is provided with aerodynamic roughness and the other hemisphere has an aerodynamically smooth surface.

Figure 1:
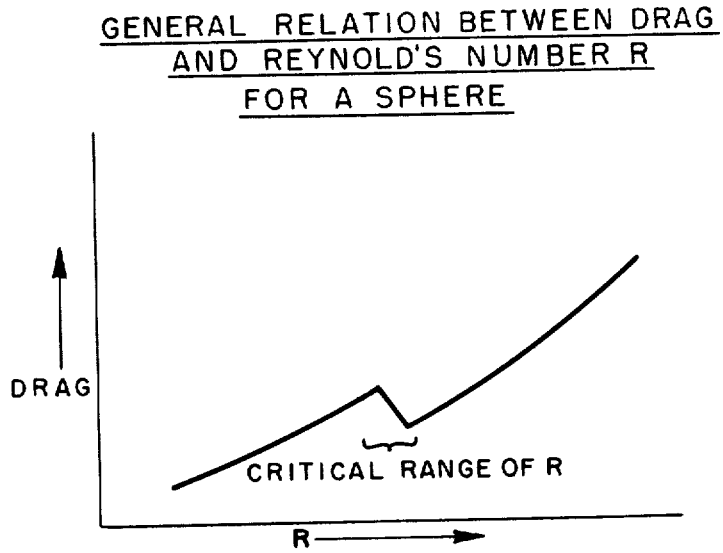
FIG. 1 is a curve illustrating the relation between the drag and the Reynold's Number R for a sphere.
Figure 2:
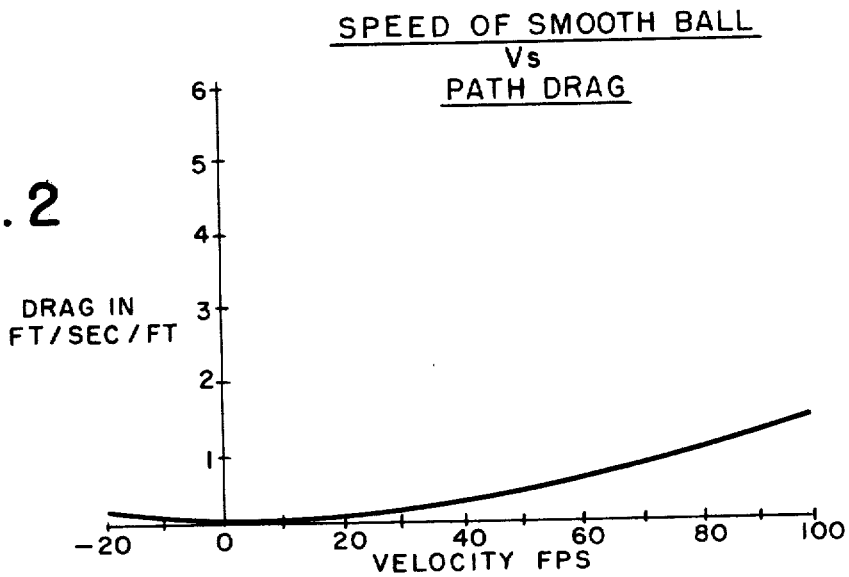
FIG. 2 is a curve illustrating the relationship between drag and velocity for a ball on a ballistic flight path and having its entire surface aerodynamically smooth.

Referring generally to the drawings, FIG. 2 illustrates the drag characteristics of a smooth ball launched in ballistic flight. Following the curve of FIG. 2 from right to left the initial drag is maximum, and gradiently decays to zero as the velocity of the ball approaches zero. This drag curve is monotonic because the critical Reynold's number would occur at a range of velocity higher than the maximum speed, depicted in FIG. 2 (100 feet per second).

Figure 3:
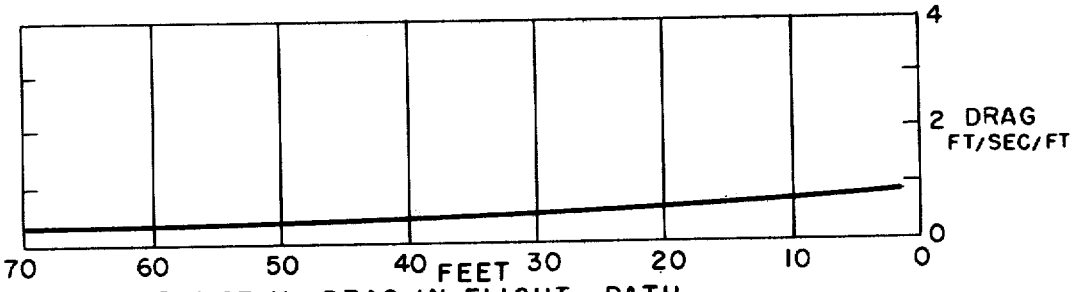
FIG. 3 is a curve illustrating the relationship between net drag and distance travelled in ballistic flight for a spinning ball having aerodynamically smooth surface characteristics, launched from the right and travelling to the left in the drawing.
Figure 4:
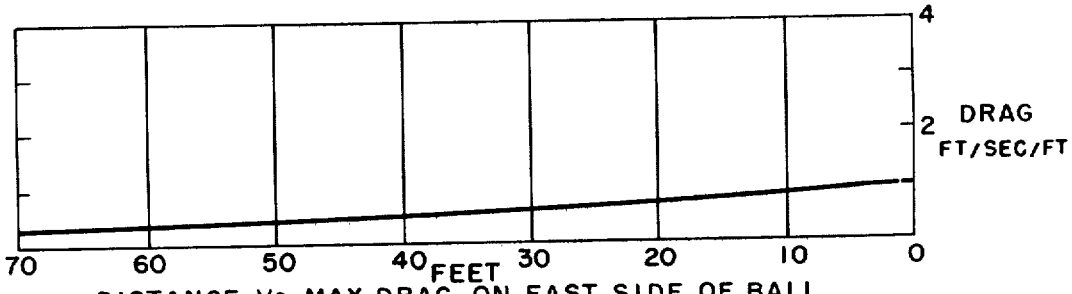
FIG. 4 is a curve showing the relationship between distance travelled in ballistic flight, travelling from right to left, and the maximum drag created on the fast side of a spinning ball having a smooth surface.

FIGS. 3–7 illustrate the effect of the drag depicted in FIG. 2 on an aerodynamically smooth ball of three inches diameter launched on a ballistic trajectory at about 55 feet/second and spinning at about 10 revolutions per second, so as to create a surface speed of about 8 feet/second at the equator. The ball is travelling from right to left in the drawings. FIG. 3 shows that net drag gradually decreases as ballistic flight proceeds and the speed of the ball decreases. FIG. 4 illustrates the maximum values of this drag on the fast side of the spinning ball, i.e., the side of the ball travelling in a direction opposite to the direction of the center of mass; this side travels at a higher speed relative to the air stream than the center of mass does. Since the velocity of the points on this side of the ball is high, the drag is likewise relatively high.

Figure 5:
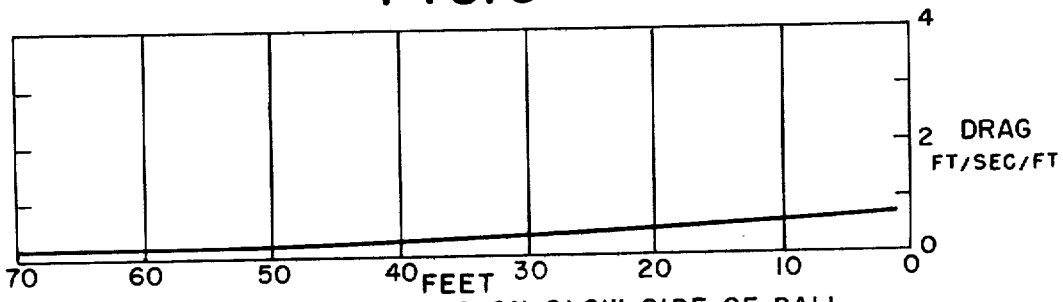
FIG. 5 is a curve of the same smooth ball as in FIG. 4, showing the relationship between distance travelled, from right to left, and the maximum drag on the slow side of the spinning ball.
Figure 6:
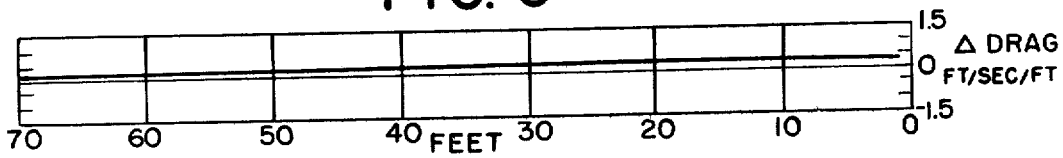
FIG. 6 is a curve showing the relationship between distance travelled, from right to left, and the difference in maximum drag between the fast and slow sides of the spinning smooth ball referred to in FIGS. 3-5.
Figure 7:
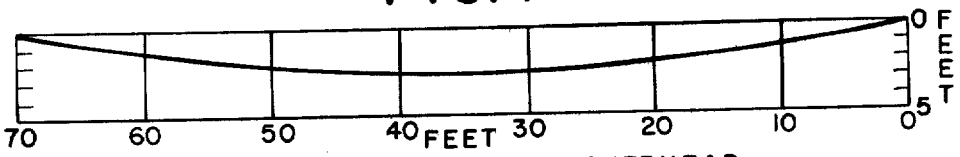
FIG. 7 is a curve showing the flight trajectory, as viewed from overhead, of the smooth spinning ball referred to in FIGS. 3-6, with the vertical scale slightly expanded to more clearly illustrate the extent of the Magnus curve travelled by the smooth ball.

FIG. 5 shows the drag on the opposite or slow side of the ball, e.g., the side travelling in the same direction as the center of mass. A comparison of FIGS. 4 and 5 shows that drag on the slow side is lower than the drag on the fast side. This difference between the drag on the fast and slow sides of the spinning ball has the same sign throughout the ballistic trajectory, as shown by FIG. 6. Thus, a lateral force constantly toward the fast side of the ball is created by the drag differential. This lateral force causes the ball to travel along a monotonic Magnus curve, such as simulated by the trajectory shown in FIG. 7.

The relationships and characteristics of a smooth ball as shown in FIGS. 2–7 are typical of the performances of prior devices. In accordance with this invention, this performance is changed and improved by providing the ball with aerodynamic roughening on selected portions of its surface. As described above, the roughness modifies the characteristics of fluid flow in the boundary layer so that the critical range of Reynolds number at various points on the surface of the ball can be passed through without excessive forward or rotational launch speeds for the ball. The desired performance of the ball, in response to passage through the critical range of Reynolds number, can thus be achieved more readily with lower launch speeds, such as speeds possible with a hand launch.

Figure 8:
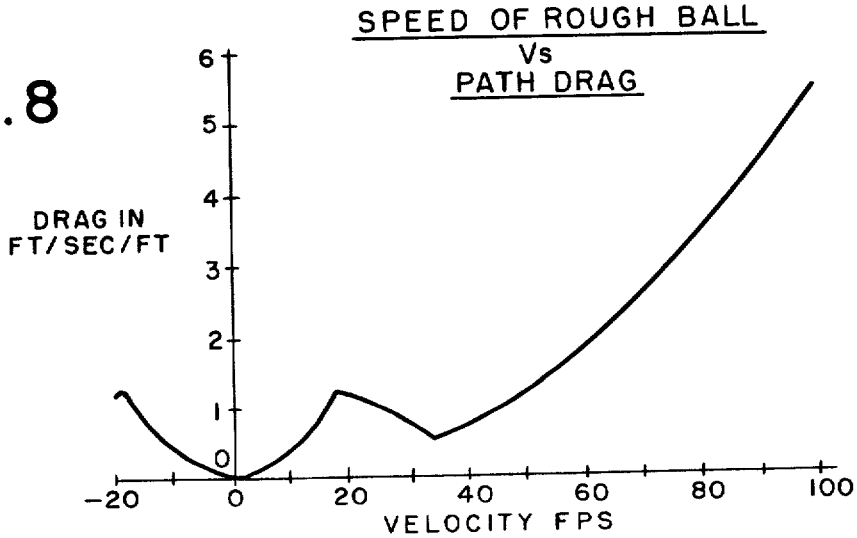
FIG. 8 is a curve, illustrating the relationship between drag and velocity for a ball on a ballistic flight path and having its entire surface provided with aerodynamic roughness pursuant to this invention.

The curve of FIG. 8 illustrates the effect of the surface roughening in accordance with this invention. Since the surface of the ball is roughened, the drag forces are generally higher at a given velocity than they are on the smooth ball shown in FIG. 2. Following the curve of FIG. 8 from right to left, the initial drag is maximum and at first decreases with a decrease in the speed of the ball in ballistic flight. Then, as the Reynolds number enters the critical range for any point on the surface of the ball, the drag at that point tends to increase with decreasing speed, as shown by the rise in the curve of FIG. 8 between about 34 and 18 fps. This increase in drag with decreasing velocity, over the critical range of R is due to the transition from turbulent to laminar flow in the boundary layer and the resultant forward movement of the separation of the boundary layer from the ball with increase in size of the wake. As shown in FIG. 8, the effect is thereafter reversed, so that the drag resumes decreasing with the decreasing speed of the ball. These changes associated with the "kink" in the drag curve cause the direction of the net lateral forces on the ball to go through two reversals of sign.

Figure 9:
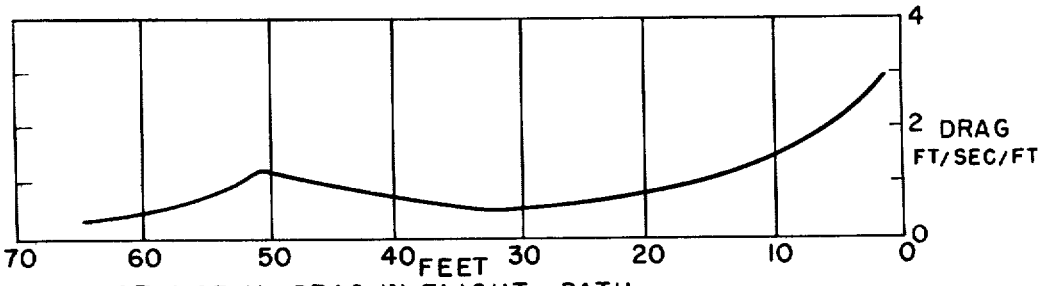
FIG. 9 is a curve showing the relationship between net drag and distance travelled in ballistic flight for a spinning ball having aerodynamically roughened surface characteristics in accordance with this invention; launched from the right and travelling to the left in the drawing.
Figure 10:
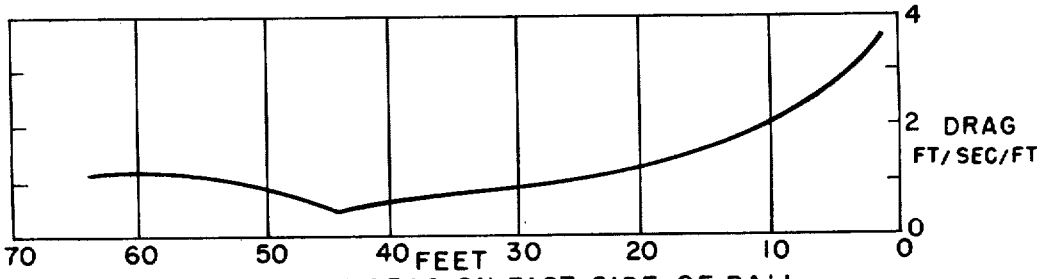
FIG. 10 is a curve showing the relationship between distance travelled in ballistic flight, from the right to the left, and the maximum drag on the fast side of a spinning ball having a roughened surface.
Figure 11:
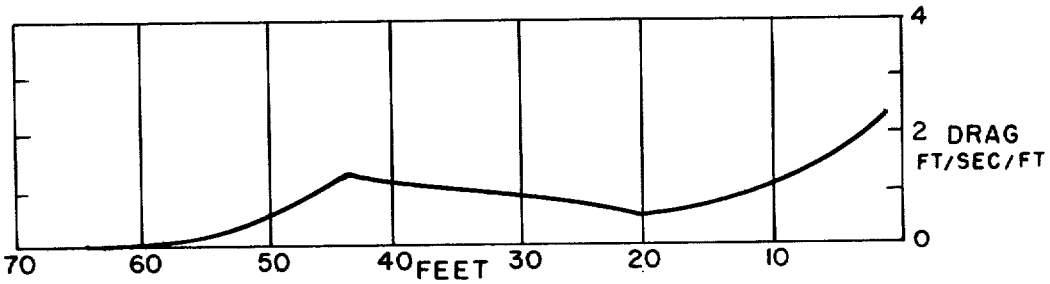
FIG. 11 is a curve of the same ball as in FIG. 10, showing the relationship between distance travelled, from the right to the left, and the maximum drag on the slow side of the spinning ball.

FIGS. 9–13 illustrate the effect of the drag depicted in FIG. 8 on a ball having aerodynamic roughening distributed over the entire surface, of three inches diameter, launched on a ballistic trajectory at about 55 feet/-second and spinning at about 10 revolutions/second, so as to create a surface speed of about 8 feet/second at the equator. The ball is travelling from right to left in the drawings. FIG. 9 shows that, at first, net drag gradually decreases as ballistic flight proceeds and the speed of the ball decreases. Then, at about 33 feet into ballistic flight, as deceleration brings the ball into the range of velocities corresponding to the critical range of R values, drag begins to increase until about 51 feet into ballistic flight when, the ball having passed through the critical range of R values, drag again begins to decrease. At about 65 feet into ballistic flight the continued action of gravity has caused the ball to hit the ground.

Figure 12:
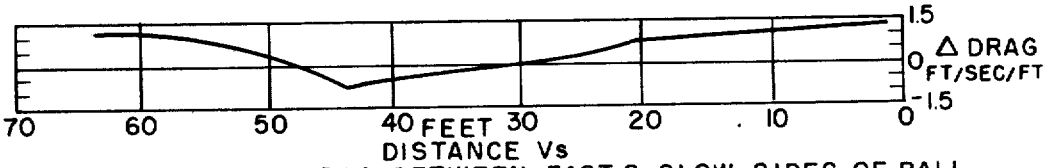
FIG. 12 is a curve showing the relationship between the distance travelled, from right to left, and the maximum difference in drag between the fast and slow sides of the spinning, roughened ball referred to in FIGS. 9-11.

FIGS. 10–13 illustrate the effect of the above described relationships between drag, velocity and distance on the fast and slow sides of spinning roughened balls. Comparing FIGS. 10 and 11, drag at first decreases on both fast and slow sides of the roughened ball but drag is at first greater on the fast side. Then about 20 feet into the ballistic flight, drag begins to increase on the slow side while it is still decreasing on the fast side. This continues until about 44 feet into the ballistic flight when drag begins to increase on the fast side of the roughened ball but resumes decreasing on the slow side of the roughened ball. This is because the slow side of the decelerating roughened ball will pass through the critical range of R values before the fast side does. FIG. 12 indicates the difference in maximum drag between the fast and slow sides of the ball. In the illustrated example drag is at first greater on the fast side of the ball than on the slow side, the difference falling to zero at about 32 feet into ballistic flight after which drag becomes greater on the slow side than on the fast side. This continues until about 48 feet into ballistic flight where the difference in drag on the two sides becomes zero again, after which it becomes increasingly greater on the fast side than on the slow side of the roughened ball.

Figure 13:
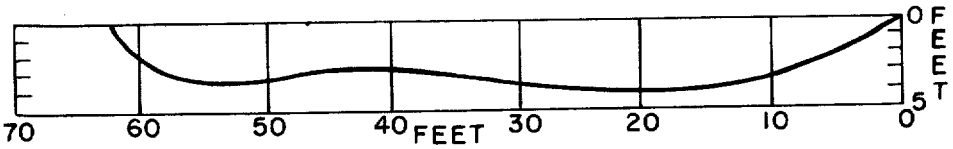
FIG. 13 is a curve showing the flight trajectory, as viewed from overhead, of the spinning roughened ball referred to in FIGS. 9-12, travelling from right to left, with the vertical scale slightly expanded to more clearly illustrate the extent of the Magnus and anti-Magnus curves.

FIG. 13 demonstrates how the shifts in the direction and magnitude of the net forces on the ball, as shown in FIG. 12, result in changes in curvature of the path of travel of the ball. As shown in FIG. 13, the flight trajectory of the ball, moving from right to left, begins in an exaggerated Magnus curve, and travels that curve through about 32 feet. Then, as the difference in drag forces on the fast and slow sides of the ball begins to change sign (See FIG. 12), the ball begins to curve in the anti-Magnus direction. The anti-Magnus curve continues as the ball travels to about 48 feet into flight when the difference in drag forces on the fast and slow sides of the ball changes sign again, and the ball resumes travelling along a Magnus curve. As seen in FIG. 13, the Magnus curve at the end of the ballistic flight is more pronounced, because the ball is travelling much more slowly in ballistic flight than at launch, although spinning almost as fast as at launch and the deflection per foot of air travelled is much greater.

Figure 14:
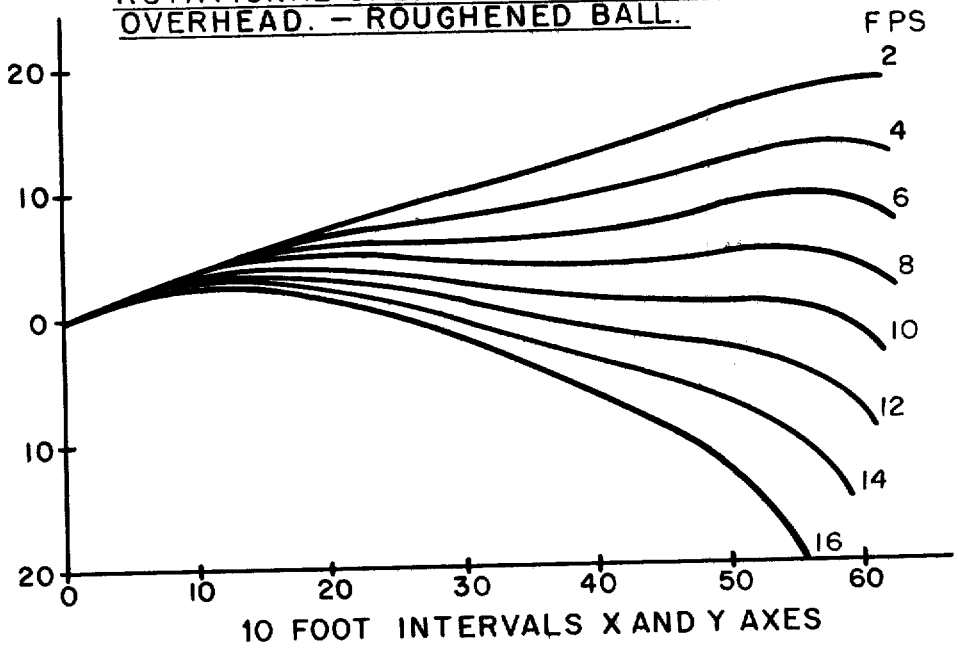
FIG. 14 is a family of curves illustrating the left-to-right trajectory, as viewed from overhead, of a spinning roughened ball at various designated equatorial rotational speeds.

These above-discussed curves demonstrate the effect of the invention on the path of travel of a ball having its entire surface aerodynamically rough. As compared to a spinning smooth ball, the spinning roughened ball of this invention can traverse a flight path characterized by combinations of enhanced Magnus and anti-Magnus curves, depending on the speed of travel of the ball. The computer-simulated trajectories of a ball moving from left to right in FIG. 14 demonstrate the effect of the invention at various rotational speeds for a roughened ball. For example, an equatorial rotational speed of about 8 fps maximizes the triple curve effect, while at speeds above 8 fps the Magnus curve is exaggerated at the beginning and at the end of flight but the Magnus and anti-Magnus effect increasingly tend to cancel each other in between.

FIGS. 15–19 illustrate various embodiments of a roughened ball made in accordance with the present invention. The preferred axis of rotation for the ball is indicated by the letter "A" in FIGS. 15–19. If the launch is by hand, the axis "A" will usually be about 30° from vertical; this will be called the standard hand launch. Thus the spin of a hand-launched ball not only produces a Magnus curve effect, but also tends to create a vertical lifting force on the ball. The ranges of forward and rotational speeds for the balls depend on whether the launch into ballistic flight uses only the hand or uses launch-assist devices. A surface speed of about 8 feet per second, is desirable; on a ball of 3" diameter this corresponds to a spin of about 10 revolutions per second. In the illustrated embodiments the balls are about three inches in diameter and have a mass of about 15 grams. An acceptable ballistic launch speed for the ball, to produce the desired effect of the surface roughening, is about 55 feet/second.

The aerodynamic roughness provided on the balls in accordance with this invention is generally indicated in the drawings by the reference "r". The roughness "r" causes parts of the surface of the ball to protrude through the laminar sublayer of the boundary layer, as described above. The preferred range of roughness may be accomplished when the surface of the ball is provided with intersecting grooves 10 and 20 which are placed at an angle of between 40° and 90° with respect to each other. A "fine" degree of roughness may be accomplished with the grooves 10 about 1/32 of an inch apart; about 0.01 inch wide; and about 0.01 inch deep. A "coarse" degree of roughness may be accomplished from grooves 10 and 20 spaced about 1/16 of an inch apart; about 1/16 of an inch wide; and about 1/16 of an inch deep. An "intermediate" degree of roughness may be accomplished by setting the grooves 10 and 20 apart by about 1/24 of an inch; and by making the grooves 1/64 of an inch wide and about 1/64 of an inch deep.

Figure 15:
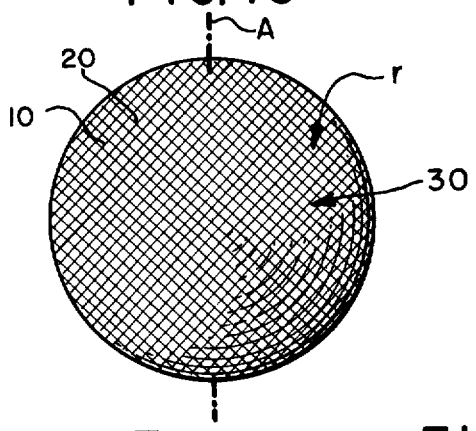
FIG. 15 is a plan view of a ball constructed in accordance with this invention having aerodynamic roughening distributed over the entire surface.

Referring to the drawings in more detail, the ball 30 in FIG. 15 is provided with a maximum area of roughness by providing the intersecting grooves 10 and 20 on its entire surface. When the grooves 10 and 20 on this ball 30 are arranged to provide a "coarse" roughness, a standard spinning hand launch will cause the ball 30 to travel over a path defining a pronounced Magnus curve. The deviation of the ball 30 from a straight horizontal path will be rightward if the front of the ball 30 is spinning to the right, and will be leftward if the front of the ball is spinning to the left.

A change in the roughness of the ball 30 will change its flight characteristics. If the grooves 10 and 20 define a "fine" degree of roughness, a standard spinning hand launch will cause the ball to travel through a triple curve. The first motion is in the Magnus direction; the next motion is in the anti-Magnus direction; and finally the ball returns to the Magnus direction of motion. The path of the ball 30 with a fine degree of roughness is illustrated in the above described FIG. 13.

Figure 16:
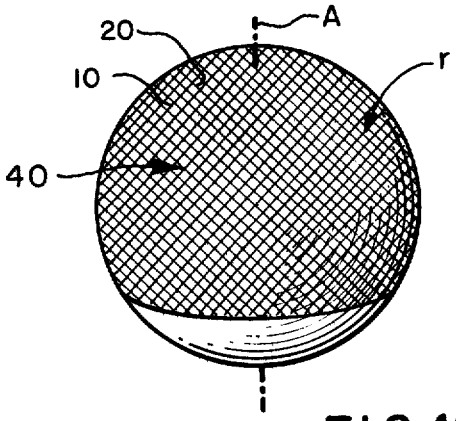
FIG. 16 is a plan view of a second embodiment of this invention showing a ball having selected aerodynamic roughness throughout its surface except for a lower surface sector which is aerodynamically smooth downwards from a latitute of between about 20° to 50° of the lower hemisphere of the ball.

Referring to FIG. 16, the illustrated ball 40 is designed to have a smooth sector in its lower hemisphere, below about 20° to 50° latitude of the ball 40. When the ball 40 is provided with an "intermediate" degree of roughness, a standard spinning hand launch will cause the ball 40 to traverse a pronounced Magnus curve. If the roughness of the ball 40 is increased to "coarse", and the mass increased to, e.g., °grams, a Magnus curve over a longer distance will result from the standard spinning hand launch. A launch which spins the ball 40 about a vertical axis, and with a "fine" degree of roughness, will cause the ball 40 to traverse a path which is initially horizontal; rises steeply to a peak; and then follows a paraboloid drop to rest.

Figure 17:
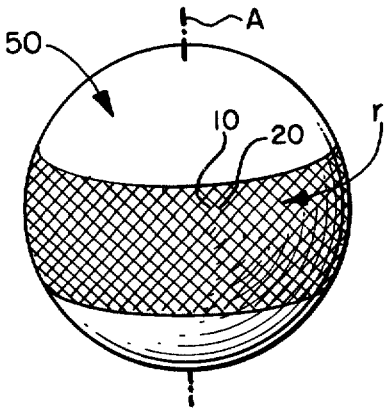
FIG. 17 illustrates a third embodiment of this invention, where the aerodynamic roughening is distributed in a wide band extending above and below the equator of the ball between about 20° and 50° of latitude of both upper and lower hemispheres and the remainder of the ball is aerodynamically smooth.

FIG. 17 illustrates a ball 50 with roughness 'r' provided along its central section between latitudes of about 20° to 50° in both hemispheres. If this ball 50 has "coarse" roughness, a Magnus curve results from a standard spinning hand launch. Degrees of roughness in the "fine" and "intermediate" range, and a launch spinning the ball 50 on a vertical axis, will cause the ball 50 to travel along a horizontal path, steeply rise to a peak and then fall to rest along a paraboloid curve.

The roughness pattern on the ball 60 shown in FIG. 18 is a reversal of the pattern of the ball 50 shown in FIG. 17. The ball 60, with any degree of roughness 'r', will have a rapidly sinking trajectory when spinning about a vertical axis. Therefore, the ball 60 preferably is launched with a tilted spin axis, to prolong the flight while preserving the pronounced sinking effect of the roughness 'r'.

The ball 70 illustrated in FIG. 19 has a roughness 'r' throughout one hemisphere. The path of travel of the ball 70 varies, depending on whether the axis of spin A is vertical or horizontal, or whether the roughened hemisphere is arranged in an upward, downward, left or right position. The degree of roughness does not materially alter the trajectory of the ball 70. If the axis of spin A is vertical and the rough side 'r' is up, as shown in FIG. 19, the ball 70 travels horizontally, steeply rises to a peak; and falls to rest along a paraboloid curve. If the rough hemisphere 'r' is down, the ball 70 has a pronounced sinking trajectory. Alternatively, if the axis is horizontal, the path of flight of the ball will be along a pronounced curve.

Although the invention has been described above with a certain degree of particularity, it should be understood that this disclosure has been made only by way of example. Consequently, numerous changes in the details of construction and in the combination and arrangement of components, as well as in the possible modes of utilization in accordance with this invention will be apparent to those familiar with the art, and may be resorted to without departing from the scope of the invention.

What is claimed is:

1. A spheroidal projectile for launching into ballistic flight, said projectile having a continuous outer surface for preventing fluid from entering within said projectile, a dense concentration of aerodynamic roughening elements per unit of surface area which protrude through the laminar sublayer of the fluid boundary layer flowing past the projectile in flight, said aerodynamic roughening being adapted to cause said projectile, when spinning at rotational speeds attainable by hand launch, to experience asymmetric lateral drag forces which drive said projectile through a flight trajectory having a first curved flight direction followed by a second curved flight direction having a curve component opposite to said first curved flight direction, where the curved flight directions are related to the density of the aerodynamic roughening elements, said projectile further including a mass of magnitude such that said curved flight directions caused by said aerodynamic roughening are accentuated at translational velocities below about 100 feet per second, such as attainable by hand launch.

2. A spheroidal projectile in accordance with claim 1 wherein said aerodynamic roughening is adapted to cause said lateral forces to drive said projectile, when spinning a ballistic flight, along an enhanced Magnus curve.

3. A spheroidal projectile in accordance with claim 1 wherein said aerodynamic roughening is adapted to cause said asymmetric lateral forces to drive said projectile, when spinning in ballistic flight, along a curved path including an anti-Magnus curve.

4. A spheroidal projectile in accordance with claim 1 wherein said aerodynamic roughening is adapted to cause said asymmetric lateral forces to drive said projectile, when spinning in ballistic flight, along a curves path including a Magnus and an anti-Magnus curve.

5. A spheroidal projectile in accordance with claim 1 wherein said aerodynamic roughening is adapted to cause said assymmetric lateral forces to drive said projectile, when spinning in ballistic flight, along a curved path which includes successively a Magnus curve, an anti-Magnus curve and a Magnus curve.

6. A spheroidal projectile in accordance with claims 1, 2, 3, 4 or 5 adapted to be launched by hand and spun on an axis inclined from the vertical axis.

7. A ball in accordance with claim 1 wherein the surface of said ball is provided with a coarse degree of aerodynamic roughening which causes said ball, when spinning in ballistic flight, to be driven along an enhanced Magnus curve.

8. A ball in accordance with claim 7 wherein said coarse aerodynamic roughening comprises intersecting surface grooves on said ball having a width and depth in the range of between 0.03125 inches and 0.0625 inches.

9. A ball in accordance with claim 8 wherein said grooves on the surface of said ball are arranged to intersect at an angle of between about 40° and 90°, and are spaced about 0.0625 inches apart.

10. A ball in accordance with claim 1 wherein the surface of said ball is provided with a fine degree of aerodynamic roughening which causes said ball, when spinning in ballistic flight, to be driven along a multicurved flight path beginning with a Magnus curve; continuing with an anti-Magnus curve; and terminating in a Magnus curve.

11. A ball in accordance with claim 10 wherein said fine aerodynamic roughening comprises intersecting surface grooves on said ball having a width and depth in the range of between about 0.01 inches and about 0.03125 inches.

12. A ball in accordance with claim 11 wherein said grooves on the surface of said ball are arranged to intersect at an angle of between about 40° and 90°, and are spaced about 0.03125 inches apart.

13. The invention in accordance with claim 1 wherein said projectile comprises a ball having said aerodynamic roughening on its surface above about 20° to 50° of latitude in the lower hemisphere of said ball and having a smooth surface therebelow.

14. A ball in accordance with claim 13 wherein said aerodynamic roughening has a course degree and comprises intersecting grooves in the surface of said ball having a width and depth in the range of between 0.03125 inches and 0.0625 inches.

15. A ball in accordance with claim 14 wherein said grooves on the surface of said ball are arranged to intersect at an angle of between about 40° and 90° and are spaced about 0.0625 inches apart.

16. A ball in accordance with claim 13 wherein said aerodynamic roughening has a fine degree and comprises intersecting grooves in the surface of said ball having a width and depth in the range of between about 0.01 inches and 0.03125 inches.

17. A ball in accordance with claim 16 wherein said grooves on the surface of said ball are arranged to intersect at an angle of between about 40° and 90° and are spaced about 0.03125 inches apart.

18. The invention in accordance with claim 1 wherein said projectile comprises a ball having said aerodynamic roughening located in the center portion between about 20° and 50° of latitude of both upper and lower hemispheres of said ball.

19. A ball in accordance with claim 18 wherein said aerodynamic roughening has a course degree and comprises intersecting grooves in the surface of said ball having a width and depth in the range of between 0.03125 inches and 0.0625 inches.

20. A ball in accordance with claim 19 wherein said grooves on the surface of said ball are arranged to intersect at an angle of between about 40° and 90° and are spaced about 0.0625 inches apart.

21. A ball in accordance with claim 18 wherein said aerodynamic roughening has a fine degree and comprises intersecting grooves in the surface of said ball having a width and depth in the range of between about 0.01 inches and 0.03125 inches.

22. A ball in accordance with claim 21 wherein said grooves on the surface of said ball are arranged to intersect at an angle of between about 40° and 90° and are spaced about 0.03125 inches apart.

23. The invention in accordance with claim 1 wherein said projectile comprises a ball having said aerodynamic roughening located above and below the latitude of about 20° to 50° in both upper and lower hemispheres of said ball.

24. A ball in accordance with claim 23 wherein said aerodynamic roughening has a coarse degree and comprises intersecting grooves in the surface of said ball having a width and depth in the range of between 0.03125 inches and 0.0625 inches.

25. A ball in accordance with claim 24 wherein said grooves on the surface of said ball are arranged to intersect at an angle of between about 40° and 90° and are spaced about 0.0625 inches apart.

26. A ball in accordance with claim 23 wherein said aerodynamic roughening has a fine degree and comprises intersecting grooves in the surface of said ball having a width and depth in the range of between about 0.01 inches and 0.03125 inches.

27. A ball in accordance with claim 27 wherein said grooves on the surface of said ball are arranged to intersect at an angle of between about 40° and 90° and are spaced about 0.03125 inches apart.

28. The invention in accordance with claim 1 wherein said projectile comprises a ball having said aerodynamic roughening located on one of the hemispheres of said ball and the other hemisphere of said ball is smooth.

29. A ball in accordance with claim 28 wherein said aerodynamic roughening has a course degree and comprises intersecting grooves in the surface of said ball having a width and depth in the range of between 0.03125 inches and 0.0625 inches.

30. A ball in accordance with claim 29 wherein said grooves on the surface of said ball are arranged to intersect at an angle between about 40° and 90° and are spaced about 0.0625 inches apart.

31. A ball in accordance with claim 28 wherein said aerodynamic roughening has a fine degree and comprises intersecting grooves in the surface of said ball having a width and depth in the range of between about 0.01 inches and 0.03125 inches.

32. A ball in accordance with claim 31 wherein said grooves on the surface of said ball are arranged to intersect at an angle of between about 40° and 90° and are spaced about 0.03125 inches apart.

* * * * *